US009874017B2

(12) United States Patent
Jenkins et al.

(10) Patent No.: US 9,874,017 B2
(45) Date of Patent: Jan. 23, 2018

(54) ROLL STARTER ROOFING PRODUCT WITH REINFORCEMENT COMPONENT

(71) Applicant: CertainTeed Corporation, Valley Forge, PA (US)

(72) Inventors: Robert L Jenkins, HoneyBrook, PA (US); Gregory F Jacobs, Oreland, PA (US)

(73) Assignee: CERTAINTEED CORPORATION, Valley Forge, PA (US)

( * ) Notice: Subject to any disclaimer, the term of this patent is extended or adjusted under 35 U.S.C. 154(b) by 0 days.

(21) Appl. No.: 14/805,636

(22) Filed: Jul. 22, 2015

(65) Prior Publication Data

US 2016/0024794 A1 Jan. 28, 2016

Related U.S. Application Data

(60) Provisional application No. 62/027,569, filed on Jul. 22, 2014.

(51) Int. Cl.

| | |
|---|---|
| ***E04D 5/12*** | (2006.01) |
| ***E04D 5/14*** | (2006.01) |
| *E04D 5/10* | (2006.01) |
| *E04D 13/158* | (2006.01) |

(52) U.S. Cl.

CPC ..... *E04D 5/12* (2013.01); *E04D 5/148* (2013.01); *E04D 5/10* (2013.01); *E04D 13/158* (2013.01)

(58) Field of Classification Search

CPC ..... E04D 5/12; E04D 5/148; E04D 13/158; E04D 5/10

See application file for complete search history.

(56) References Cited

U.S. PATENT DOCUMENTS 1,434,200 A * 10/1922 Chase ..... E04D 5/142 52/530
1,489,898 A * 4/1924 Petersen ..... E04D 5/142 52/530
1,596,272 A * 8/1926 Jordan ..... E04D 1/26 52/521
2,003,503 A * 6/1935 Eason ..... E04D 1/34 206/321
2,044,788 A * 6/1936 Ochs ..... D06N 5/00 52/419
2,160,845 A * 6/1939 Eason ..... E04D 5/142 52/420
2,215,349 A * 9/1940 Eason ..... E04D 5/142 206/321
2,222,868 A * 11/1940 Hollister ..... E04D 5/10 428/143
3,292,334 A * 12/1966 Craig ..... E04D 5/10 428/142
3,326,366 A * 6/1967 Butterfield ..... E04D 5/10 427/417

(Continued)

*Primary Examiner* — Patrick J Maestri
(74) *Attorney, Agent, or Firm* — Pepper Hamilton LLP

(57) ABSTRACT

A roll starter roofing product includes a starter sheet and a reinforcement component applied to the starter sheet. The starter sheet includes an adhesive portion which is operable to be adhesively applied to a roof deck surface and an overhanging portion operable to extend over an edge of the roof deck surface. The reinforcement component is operable to resist bending of the overhanging portion in a direction transverse to the edge of the roof deck surface upon installation.

7 Claims, 6 Drawing Sheets

(56) References Cited

U.S. PATENT DOCUMENTS 3,468,086 A * 9/1969 Warner ..... E04D 3/355 156/202
3,541,745 A * 11/1970 Probst ..... E04D 1/26 52/105
3,813,280 A * 5/1974 Olszyk ..... E04D 1/26 156/278
4,007,835 A * 2/1977 Klothe ..... A41D 27/06 112/418
4,404,783 A * 9/1983 Freiborg ..... E04D 1/205 52/518
4,546,589 A * 10/1985 Seaman ..... B29C 66/435 52/518
4,680,909 A * 7/1987 Stewart ..... E04D 3/358 52/409
4,736,552 A * 4/1988 Ward ..... E04B 1/642 52/309.13
4,751,122 A * 6/1988 May ..... C09J 7/045 428/192
RE32,710 E * 7/1988 Seaman ..... E04D 5/14 52/518
5,037,685 A * 8/1991 Richards ..... E04D 1/26 428/136
5,154,025 A * 10/1992 Brown ..... E04D 13/0459 52/12
5,365,709 A * 11/1994 Lassiter ..... D06N 5/00 156/92
5,452,797 A * 9/1995 Pollard ..... B65D 85/672 206/413
5,593,771 A * 1/1997 Lawless ..... C09J 7/026 156/157
5,950,321 A * 9/1999 Pena ..... E04D 13/00 33/646
6,050,042 A * 4/2000 Durachko ..... E04D 5/12 52/314
6,511,741 B1 * 1/2003 Hungarter ..... E04D 15/025 428/343
7,146,771 B2 * 12/2006 Swann ..... E04D 5/12 52/408
2003/0032356 A1 * 2/2003 Kiik ..... A47G 27/0468 442/327
2003/0070391 A1 * 4/2003 Tachauer ..... A44B 18/0049 52/745.21
2004/0081789 A1 * 4/2004 Kim ..... B32B 9/00 428/40.3
2004/0126542 A1 * 7/2004 Fujiwara ..... C09J 7/0271 428/172
2004/0154265 A1 * 8/2004 Knowlton ..... E04B 1/66 52/741.1
2004/0172899 A1 * 9/2004 Paradise ..... C08L 95/00 52/302.1
2004/0172908 A1 * 9/2004 Swann ..... E04D 5/12 52/518
2005/0097828 A1 * 5/2005 Hasse ..... E04D 5/12 52/60
2005/0126103 A1 * 6/2005 Scheirer ..... E04D 5/12 52/518
2005/0170125 A1 * 8/2005 Naipawer, III ..... B32B 7/12 428/41.7
2006/0096218 A1 * 5/2006 Johnson ..... E04D 12/002 52/506.01
2006/0174546 A1 * 8/2006 Kim ..... E04D 5/10 52/63
2009/0087633 A1 * 4/2009 Furgal ..... B32B 5/26 428/213
2009/0107073 A1 * 4/2009 Kalkanoglu ..... B32B 15/08 52/411
2009/0217602 A1 * 9/2009 Hungarter ..... E04D 15/02 52/105
2009/0293375 A1 * 12/2009 Schroer ..... E04D 13/1618 52/90.1
2010/0003443 A1 * 1/2010 Kalwara ..... B32B 7/06 428/41.8
2010/0024955 A1 * 2/2010 Kalwara ..... E04D 5/12 156/71
2010/0200148 A1 * 8/2010 Douglas ..... E04D 5/12 156/71
2011/0198023 A1 * 8/2011 Tippins ..... E04D 5/12 156/227
2012/0045623 A1 * 2/2012 Delaney ..... B32B 25/10 428/189
2013/0263552 A1 * 10/2013 French ..... E04D 5/10 52/745.06
2015/0024159 A1 * 1/2015 Bess ..... B32B 37/12 428/41.3
2015/0176282 A1 * 6/2015 Baker ..... E04D 12/002 52/716.2

* cited by examiner

ROLL STARTER ROOFING PRODUCT WITH REINFORCEMENT COMPONENT

CROSS-REFERENCE TO RELATED APPLICATIONS

This application claims priority to U.S. provisional application Ser. No. 62/027,569 filed Jul. 22, 2014, which is incorporated herein by reference in its entirety.

TECHNICAL FIELD

The present invention relates generally to a roll starter roofing product which combines a starter sheet and a reinforcement component in a single product. The various embodiments described herein are applicable to both eave and roof rake applications and may be integrated with various additional roofing components such as, for example, field shingles, a drip edge, and/or a gutter system.

BACKGROUND

When installing asphalt shingles on a sloped roof, a course of starter shingles is applied along the lower edge of the roof as the first course of shingles. A conventional technique for installing a row of starter strip shingles is to use a series of rectangular starter strip shingles applied consecutively along a roof surface. Starter strip singles eliminate the need for cutting shingle tabs to create a starter row. However, they are problematic because they create a series of end joints between each starter strip shingle. A roofing installer must ensure that any overlaying shingles' end joints do not line up with these starter end joints, otherwise water could enter between the joints and reach the roof deck surface. The number of end joints created in application of starter course can be reduced by use of a starter roll product. A starter roll product provides similar benefit to rectangular starter strip shingles, however, it is provided in a roll configuration such that it may extend greater distances along the roof surface.

Regardless of whether starter strip shingles or a roll starter product is used as the starter course, the starter course must be installed on the roof deck surface such that a portion extends over the eaves and edges of the roof deck to provide an extended barrier which prevents water from entering at the side of the shingles and damaging roof deck material such as the rake and fascia boards. However, conventional starter strip shingles or a roll starter products are not manufactured thick enough to provide adequate stiffness which would support the overhang portion described above. For example, a conventional starter roll product that extends more than ¾ inch over a roof surface can eventually bend and fracture, leaving the roof deck material vulnerable to water damage. As a result, the distance which a starter roll product can extend over roof deck surface is limited and a drip edge is required for all installations.

Accordingly, it is desired to provide a roofing product which provides the benefits of conventional starter roll product in combination with reinforcement allowing a portion of the roofing product to overhang the roof surface.

SUMMARY

Embodiments of the present invention address and overcome one or more of the above shortcomings and drawbacks, by providing methods, systems, and apparatuses related to a roll starter roofing product which combines a starter sheet and a reinforcement component in a single product. The technology is particularly well-suited to be included as part of a roofing system with additional components such as field shingles, a drip edge, and a gutter system. However, it should be noted that the present invention is not limited as such and may be used in various roofing system configurations.

According to some embodiments of the present invention, a roll starter roofing product comprises a starter sheet and a reinforcement component applied to the starter sheet. The starter sheet includes an adhesive portion which is operable to be adhesively applied to a roof deck surface and an overhanging portion operable to extend over an edge of the roof deck surface. The reinforcement component is operable to resist bending of the overhanging portion in a direction transverse to the edge of the roof deck surface upon installation.

Various materials may be used as the reinforcement component in the aforementioned roll starter roofing product. For example, in some embodiments, the reinforcement component comprises one or more of an additional starter sheet laminated to an upper surface of the starter sheet and/or multiple layers of granules or other raw materials applied to the starter sheet. In other embodiments, the reinforcement component is a plurality of slat members spaced longitudinally across the starter sheet. In one embodiment, these slat members are applied interior to the starter sheet.

To facilitate rolling of the aforementioned roll starter roofing product in a longitudinal direction, in some embodiments, the product includes a plurality of creases extending across a lower surface of the starter sheet. In these embodiments, the reinforcement component may comprise slat members applied at locations corresponding to the creases. In some embodiments, the creases are discontinuous and not of a uniform opening in a width-wise direction across the lower surface of the starter sheet.

In some embodiments, the roll starter roofing product includes adhesive zones applied to an upper surface and/or lower surface of the starter sheet. A release zone (e.g., release tape) may be placed on the upper surface of the starter sheet to contact the adhesive zones on the lower surface while the roll starter roofing product is in a rolled configuration. Similarly, a release zone may be placed on the lower surface to contact the adhesive zones on the upper surface while the product is in the rolled configuration. In one embodiment, an alpha-numeric marker is printed on the release zone. In some embodiments, the roll starter roofing product also includes a selvedge section located on the adhesive portion on an in-roof side of the starter sheet. A release zone may be applied to an anterior surface of the selvedge section and, in some embodiments, may also have an alpha-numeric marker printed on it. The alpha-numeric markers may identify, for example, one or more of a production date, a production plant, or a production company.

According to other embodiments of the present invention, a roll starter roofing product includes a laminated sheet comprising two or more starter sheets laminated together. The laminated sheet is operable to resist bending in a widthwise direction when installed on a roof deck surface. A plurality of creases extends longitudinally across a lower surface of the laminated sheet, allowing rolling of the laminated sheet while preserving the laminated sheet's resistance to bending. In some embodiments, slat members are applied across the laminated sheet at interior or exterior locations corresponding to the plurality of creases. In some embodiments, the upper or lower surface of the laminated sheet may include adhesive zones with corresponding release zones to allow the laminated sheet to be stored and transported in a rolled configuration.

According to other embodiments of the present invention, a roll starter roofing product includes a starter sheet sized to include an overhanging drip edge portion when installed on a roof deck surface. Slat members (e.g., composed of a metal-based, plastic-based, or composite material) are applied to the starter sheet to aid in the resistance bending of the overhanging drip edge portion when the starter sheet is installed on the roof deck surface. In one embodiment, these slat members are each tapered in shape.

Additional features and advantages of the invention will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION

The following disclosure describes the present invention according to several embodiments directed at methods, systems, and apparatuses related to a roll starter roofing product comprising a starter sheet and a reinforcement component applied to the starter sheet. The reinforcement component is operable to resist bending of the starter sheet in a direction transverse to the edge of the roof deck surface upon installation of the starter sheet. The various embodiments described herein are applicable to both eave and roof rake applications and may be integrated with various additional roofing components such as, for example, field shingles, a drip edge, and/or a gutter system.

Figure 1:
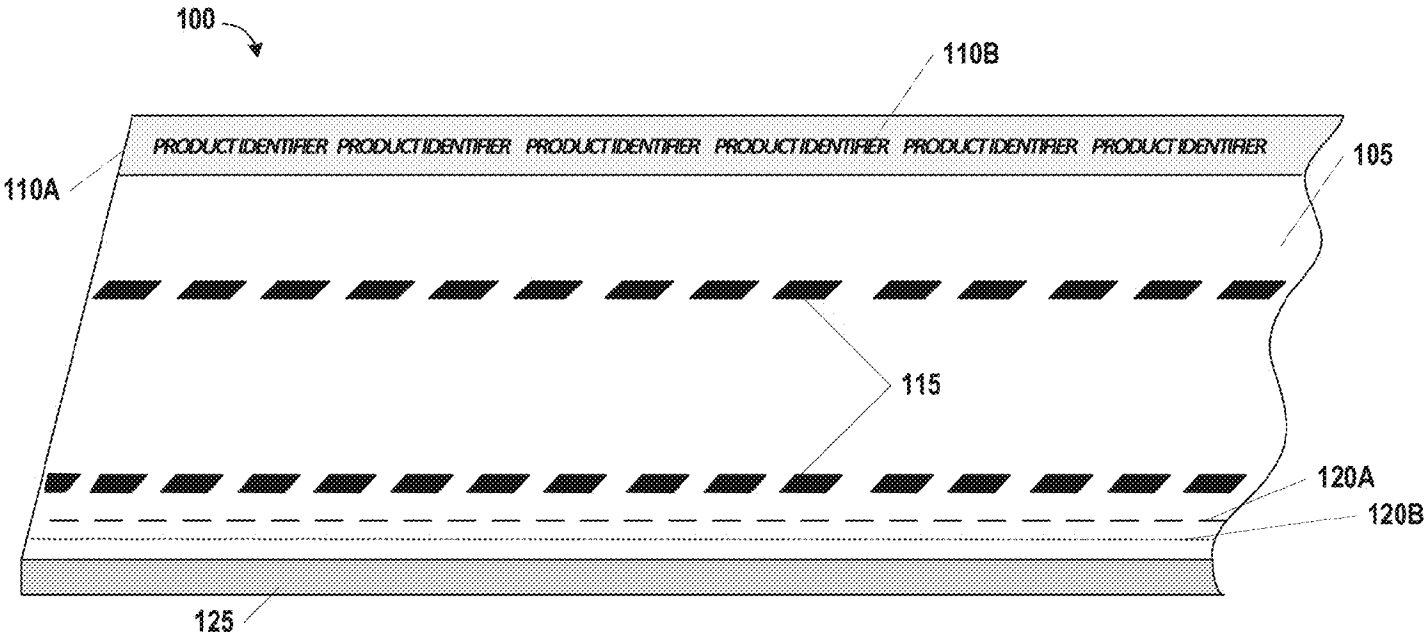
FIG. 1 provides a top surface view of a roll starter roofing product, according to some embodiments of the present invention.

FIG. 1 provides a top surface view of a roll starter roofing product 100, according to some embodiments of the present invention. As shown in the example of FIG. 1, the roll starter roofing product 100 includes a starter sheet 105 designed to be affixed to roofing underlayment applied on roof deck surface. The starter sheet 105 includes an adhesive zone comprising a plurality of adhesive strips 115 extending laterally across the top of the starter sheet 105. These adhesive sealing strips 115 are configured to allow for adhesion to roof shingles installed directly over the starter sheet 105. The bottom surface also includes an adhesive zone (not shown in FIG. 1) which adheres the starter sheet 105 to the roof and prevents wind uplift at the roof edge on which the starter sheet 105 is installed. The adhesive zone on the bottom surface may comprise, for example, one or more lines of adhesive or a continuous sheet of adhesive applied to the entire bottom surface or a just a portion of the bottom surface configured to be applied to the roof deck.

As explained in greater detail below, in some embodiments, the roll starter roofing product 100 may be arranged in a rolled configuration. To prevent adhesion between the adhesive sealing strips 115 and other portions of the starter sheet 105 while in a rolled configuration, a release zone (e.g. release paper) may be provided over the adhesive sealing strips 115. During installation, as the roll starter roofing product 100 is unrolled over the roof deck surface, the release zones are removed to allow adhesion to the first course of roofing shingles and the roofing underlayment, respectively. The adhesive sealing strips 115 are positioned such that at least one line of sealing strips lines as close as possible to the edge of the roof.

Continuing with reference to FIG. 1, the roll starter roofing product 100 further includes a product identifier 110B printed on the selvedge portion 110A of the roll starter roofing product 100 at a top in-roof portion of the starter sheet 105. It should be noted that printing is only one manner in which the product identifier 110B may be placed on the selvedge portion 110A. For example, in other embodiments, the product identifier 110B may be embossed or debossed on the top surface, or may be engraved or impressed in a different material on the top surface of the roll starter roofing product 100. Additionally, in some embodiments, the color of the product identifier 110B may be selected to create a desired level of visibility (e.g., more or less noticeable with respect to the background) of the product identifier 110B on the top surface of the starter sheet 105. In some embodiments, the product identifier 110B includes indicia of the manufacturer such as the manufacturer's name and/or a logo associated with the manufacturer. In other embodiments, the product identifier 110B includes information regarding the manufacture of the product such as, for example, the location of the manufacturing facility, a date associated with the manufacture of the integrated roofing system, and/or a time associated with the manufacture of the system. In other embodiments, the product identifier 110B may also include functional information such as a targeted fastener location.

A reinforcement component 125 is applied to the roll starter roofing product 100 to make it resist bending of the starter sheet 105 in a direction transverse to the edge of the roof deck surface upon installation. Additionally, the reinforcement component 125 is designed to provide high web tensile (i.e., tear) strength to the starter sheet 105. Although the reinforcement component is depicted in FIG. 1 as being between the top and bottom surface of the starter sheet 105, in other embodiments, the component may be on the top or bottom surface itself.

In some embodiments, the reinforcement component 125 is only applied to a portion of the roll starter roofing product 100 designed to overhang the roof surface, while in other embodiments the reinforcement component 125 is applied to entire system 100. There are various reinforcement components that may be used. In some embodiments, the reinforcement component 125 comprises one or more additional starter sheets adhered to the starter sheet 105. In other embodiments, the reinforcement component 125 may be additional and/or modified key raw materials added to the product composition of the starter sheet 105 during manufacturing. These key raw materials may correspond, for example, to the asphalt and/or glass mat used in the starter sheet 105. In some embodiments, the reinforcement component 125 comprises a plurality of slat members either embedded in the starter sheet 105 or placed on an exterior surface of the starter sheet 105. These slat members are described in greater detail below with respect to FIGS. 3A and 3B. The exact configuration of the reinforcement component 125 may be selected to meet American Society for Testing and Materials (ASTM) requirements such as regarding wind resistance, tear strength, and flexural strength.

Because the reinforcement component allows the starter sheet 105 to resist bending in a direction transverse to the edge of the roof deck surface upon installation, it may be installed with a portion of the sheet overhanging the roof edge. Typically, the amount of overhang permitted in roofing installations is dictated by local code and/or ordinances. In some embodiments, to aid in quick installation, one or more indicators are printed on the face of the starter sheet 105 allowing for alignment with a roof edge. In the example of FIG. 1, two lines are printed. A first line 120A is printed at a predetermined distance (e.g., 1 inch) from the roof edge. A second line 120B is printed at a second, shorter predetermined distance (e.g., ¾ inch) from the roof edge. In other embodiments, additional lines may be printed at different distances. Conversely, in some embodiments, only a single line may be printed or no line at all. In embodiments where lines are printed, an alphanumeric indicator may also be printed on the face of the starter sheet 105 specifying geographic locations where each line is applicable. Additionally or alternatively, an alphanumeric indicator may indicate installation guidelines dependent on installation of a drip edge. For example, the first line 120A may be indicated as proper installation when a drip edge is not used, while the second line 120B may be indicated as a proper installation when a drip edge is used.

Figure 2A:
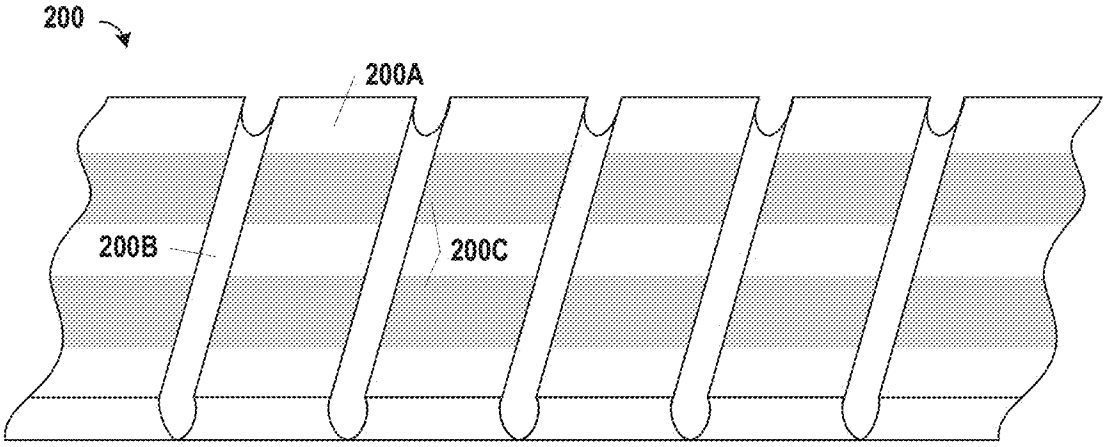
FIG. 2A shows a lower surface of a roll starter roofing product segmented into a plurality of roll starter roofing product segments, according to some embodiments of the present invention.
Figure 2B:
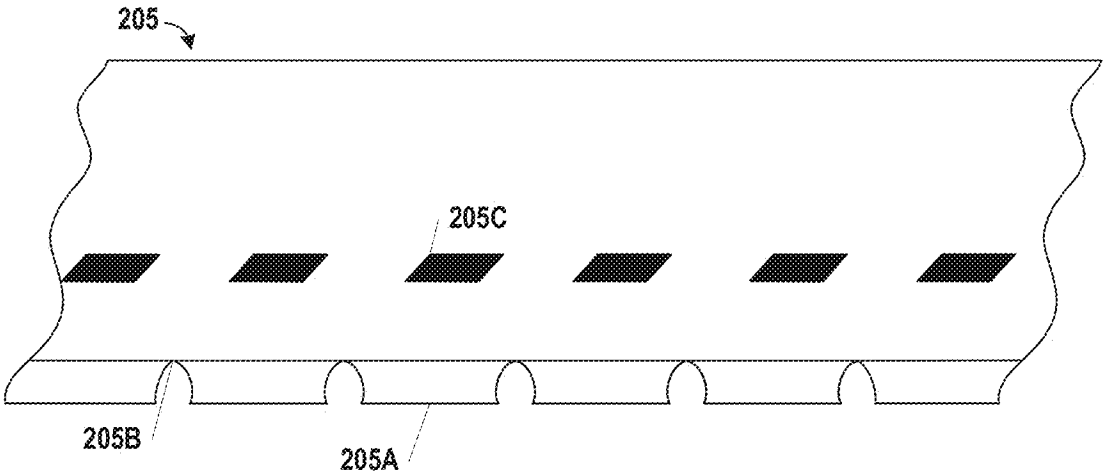
FIG. 2B shows the upper surface of the roll starter roofing product depicted in FIG. 2A, according to some embodiments of the present invention.

As noted above, in some embodiments, the roll starter roofing product 100 may be arranged in a roll configuration. This provides various benefits including, for example, making transport more convenient and installation easier. However, due to the stiffness provided by the reinforcement component 125, it may be difficult to roll the roll starter roofing product 100 in some embodiments without further modification to the system 100. FIGS. 2A and 2B illustrate how a plurality of creases may be integrated in the roll starter roofing product 100 to allow for rolling, according to some embodiments of the present invention. FIG. 2A shows a lower surface 200 of a roll starter roofing product segmented into a plurality of roll starter roofing product segments 200A. Each roll starter roofing product segment (e.g., 200A) is separated by a crease 200B. The lower surface further includes a plurality of adhesive zones 200C allowing the lower surface to be affixed to a roof deck. In some embodiments, the adhesive zones comprise adhesive applied to the lower surface 200 of a starter roll in a dashed configuration such that adhesive is only applied to the roll starter roofing product segments 200A and not the creases 200B. FIG. 2B shows the upper surface 205 of a roll starter roofing product with a plurality of roll starter roofing product segments 205A and creases 205B which correspond to segments 200A and creases 200B, respectively depicted in FIG. 2A. The upper surface 205 also includes a plurality of upper adhesive zones 205C which allow a row of shingles to be affixed to the upper surface 205 of the roll starter roofing product. Although the creases in FIGS. 2A and 2B are depicted as continuous, it should be noted that, in other embodiments, the creases may alternatively be discontinuous and/not of a uniform opening across the face of the roll starter roofing product.

Figure 3A:
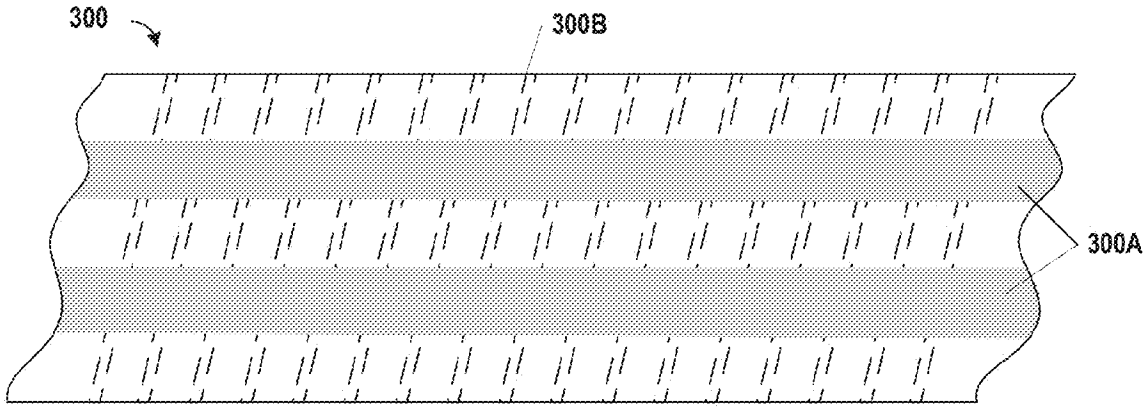
FIG. 3A shows a lower surface of a roll starter roofing product which includes slat members extending lengthwise across the lower surface, according to some embodiments of the present invention.
Figure 3B:
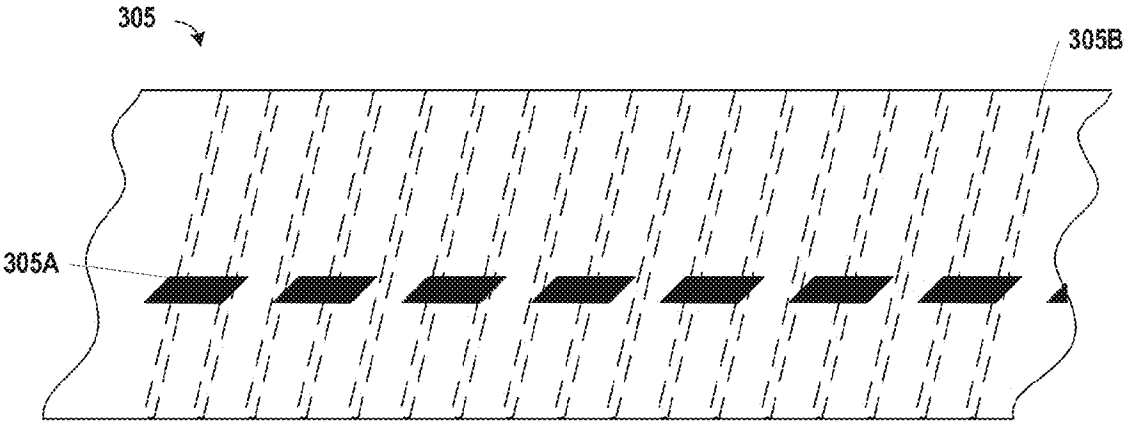
FIG. 3B shows an upper surface of the roll starter roofing product depicted in FIG. 3A, according to some embodiments of the present invention.

In some embodiments, one or more slat members are used to provide stiffness to the roll starter roofing product 100. FIGS. 3A and 3B depict an example of how slat members can be integrated with the roll starter roofing product, according to some embodiments of the present invention. FIG. 3A shows a lower surface 300 of a roll starter roofing product which includes slat members 300B extending lengthwise across the lower surface 300. These slat members 300B may be constructed of a material with a high flexural strength including, without limitation, plastic-based, wood-based, metal-based and/or composite materials. In some embodiments, the slat members are embedded in the roll starter roofing product during manufacturing. In other embodiments, the slat members 300B are attached (e.g., via adhesive) to the top or bottom surface of the roll starter roofing product after it is manufactured. The spacing and number of slat members included in the roll starter roofing product are such that they allow rolling of the roll starter roofing product. The slat members may be continuous or discontinuous with respect to their extension across the face of the roll starter roofing product. The lower surface 300 of the roll starter roofing product includes adhesive zones 300A to allow the lower surface 300 to be affixed to a roof deck surface. FIG. 3B shows an upper surface 305 of the roll starter roofing product 100 depicted in FIG. 3A, according to some embodiments of the present invention. FIG. 3B provides an illustration of the upper surface 305, with slat members 305B corresponding the slat members 300B shown in FIG. A. In the example shown in FIGS. 3A and 3B, the lower surface 300 and upper surface 305 include adhesive zones 300A and 305A, respectively.

Figure 4A:
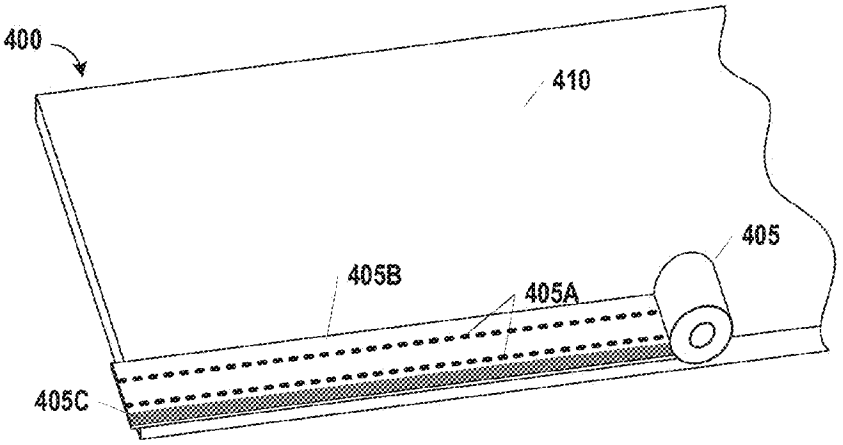
FIG. 4A shows an overhead view of an eave installation of a roll starter roofing product, according to some embodiments of the present invention.

FIG. 4A shows an overhead view of an eave installation 400 of a roll starter roofing product 405, according to some embodiments of the present invention. The roll starter roofing product 405 includes an in-roof portion 405B and an overhang portion 405C (shown shaded for emphasis). The in-roof portion 405B is designed to adhere the roll starter roofing product 405 to the roofing underlayment (not shown in FIG. 4A) or directly to the roof deck surface 410 while overhang portion 405C remains free (i.e., not attached) for extension over and beyond the roof deck edge. An adhesive zone 405A is placed near the roof edge to allow for installation of a first course of shingles along the roof edge. In the example of FIG. 4A, the roll starter roofing product 400 is configured to provide sufficient stiffness to serve as a drip edge over the roof surface. In some embodiments, the system 405 allows the overhang portion 405C to be bent down from a plane horizontal to the roof deck surface 410 to allow diversion of water into a gutter system. It should be noted that this configuration 405 is merely an example and, in other embodiments (see, e.g., FIGS. 5A and 5B), the roll starter roofing product may be applied to a roof with a conventional drip edge.

Figure 4B:
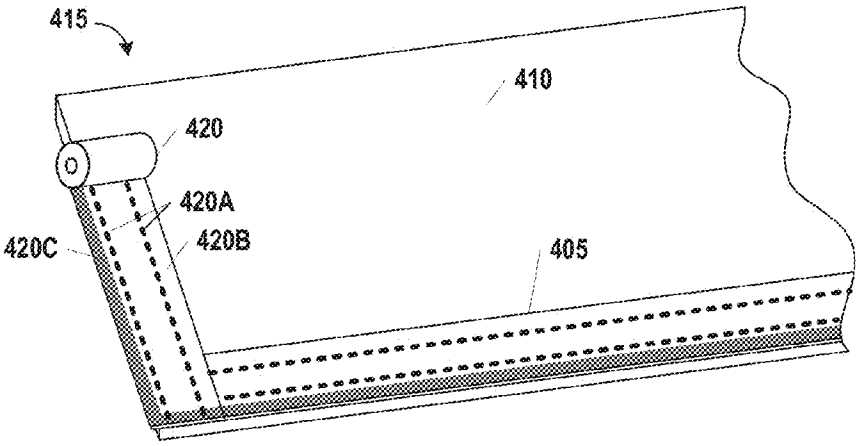
FIG. 4B shows a rake installation of a roll starter roofing product, according to some embodiments of the present invention.

FIG. 4B shows a rake installation 415 of a roll starter roofing product 420, according to some embodiments of the present invention. In the rake installation 415, the roll starter roofing product 420 is applied on the rake portion of the roof surface over the eave installation 400 of roll starter roofing product 405. As with system 400 of FIG. 4A, system 405 of FIG. 4B also includes an in-roof portion 420B and an overhang portion 420C for extension over and beyond the roof deck edge. Additionally, an adhesive zone 420A allows for adhesion to shingles upon installation.

Figure 5B:
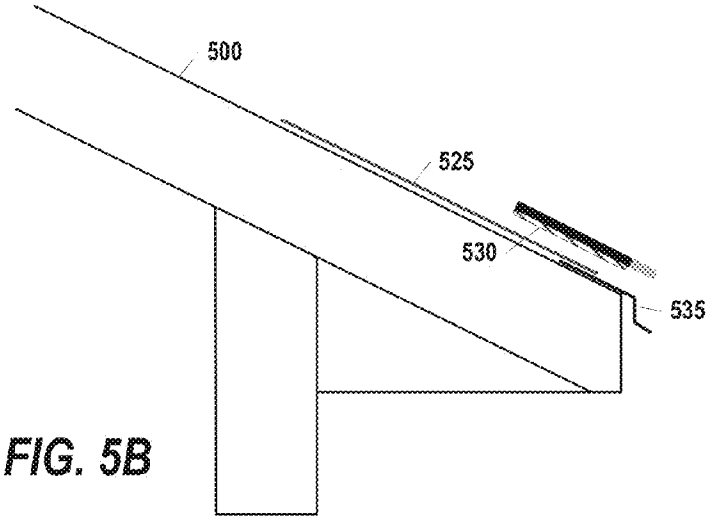
FIG. 5B shows a side view of an alternative installation of a roll starter roofing product, according to some embodiments of the present invention.
Figure 5A:
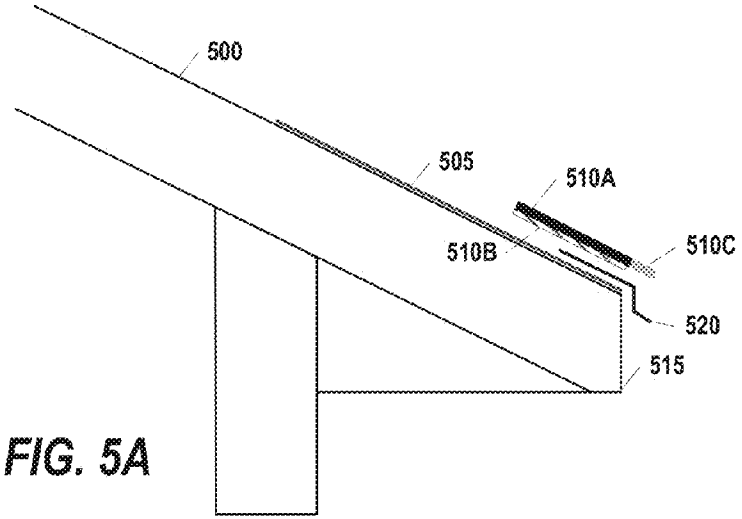
FIG. 5A provides a side view of installation of a roll starter roofing product, according to some embodiments of the present invention.

FIG. 5A provides a side view of installation of a roll starter roofing product, according to some embodiments of the present invention. In the example of FIG. 5, underlayment 505 is applied over a roof deck surface 500. A drip edge 520 is installed over the underlayment 505. As is well understood in the art, a drip edge is a plastic or sheet-metal strip attached to the roof which directs water down into a gutter system. On top of the drip edge 520, an in-roof portion 510A of the roll starter roofing product remains attached to the underlayment 505 and the drip edge 520 via an adhesive zone 510B (e.g., peel-and-stick adhesive). The adhesive zone 510B is positioned to contact both a portion of the underlayment 505 and the drip edge 520 when installed. An overhang portion 510C of the roll starter roofing product extends over the fascia board 515. The size of the overhang portion 510C is such that it allows water to be diverted down off the roof surface into the drip edge 520. In some embodiments, the roll starter roofing product may include an indicator (e.g., dotted line) on the upper surface of the product to allow for proper alignment with the roof edge during installation. FIG. 5B shows a side view of an alternative installation of a roll starter roofing product, according to some embodiments of the present invention. In this alternative installation, the underlayment 525 is installed over a portion of the drip edge 535, as opposed to under it as in FIG. 5A. Similar to the installation of FIG. 5A, in the example of FIG. 5B, an adhesive zone 530 contacts both a portion of the underlayment 525 and the portion of the drip edge 535 not covered by the underlayment upon installation.

Figure 6A:
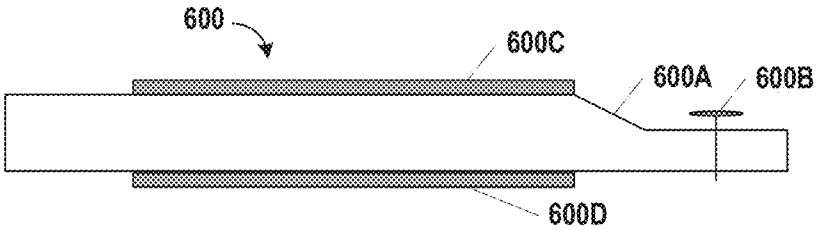
FIG. 6A provides an illustration of a first selvedge edge design, as may be applied to a starter roof product according to various embodiments of the present invention.
Figure 6B:
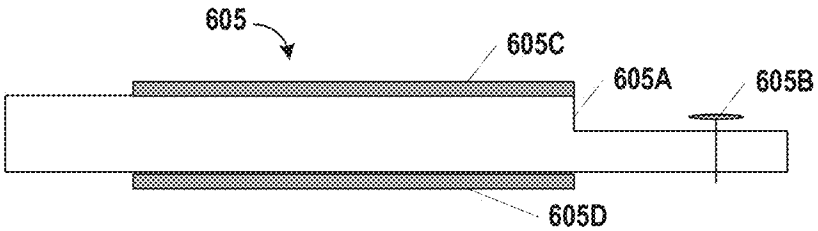
FIG. 6B provides an illustration of a second selvedge edge design, as may alternatively be applied to a starter roof product according to various embodiments of the present invention.

FIG. 6A provides an illustration of a first selvedge edge design 600, as may be applied to a starter roof product according to various embodiments of the present invention. The design 600 includes a tapered transition feature 600A below which a fastener 600B may be applied. The first selvedge edge design includes adhesive zones 600C, 600D on the upper and lower surface, respectively of the selvedge edge. FIG. 6B provides an illustration of a second selvedge edge design 605, as may alternatively be applied to a starter roof product according to various embodiments of the present invention. In contrast to the tapered transition feature 600A illustrated in FIG. 6A, the second selvedge edge design includes a straight transition feature 605A orthogonal to the location of the fastener 605B. As with the example design 600 of FIG. 6A, the second selvedge edge design 605 also includes adhesive zones 605C, 605D on the upper and lower surfaces, respectively of the selvedge edge.

The system and processes of the figures are not exclusive. Other systems and processes may be derived in accordance with the principles of the invention to accomplish the same objectives. Although this invention has been described with reference to particular embodiments, it is to be understood that the embodiments and variations shown and described herein are for illustration purposes only. Modifications to the current design may be implemented by those skilled in the art, without departing from the scope of the invention.

We claim:

1. A roll starter roofing product, the product comprising:
- a starter sheet for underlying one or more overlaying roofing products, the starter sheet comprising:
  - an adhesive portion operable to be adhesively applied to a roof deck surface upon installation of the starter sheet,
  - an overhanging portion extending over an edge of the roof deck surface upon installation of the starter sheet, and
  - a visual indicator printed on an upper surface of the starter sheet facilitating alignment of an in-roof side of the overhanging portion of the starter sheet with the edge of the roof deck surface; and
- a reinforcement component applied to the overhanging portion of the starter sheet and operable to resist bending of the overhanging portion in a direction transverse to the edge of the roof deck surface upon installation of the starter sheet, wherein the reinforcement component comprises one or more of: an additional starter sheet laminated to an upper surface of the starter sheet, and multiple layers of granules applied to the starter sheet.

2. The roll starter roofing product of claim 1, further comprising:
- a plurality of upper adhesive zones applied to the upper surface of the starter sheet; and
- a plurality of lower adhesive zones applied to a lower surface of the starter sheet.

3. The roll starter roofing product of claim 2, further comprising:
- an upper release zone placed on the upper surface of the starter sheet and contacting the plurality of lower adhesive zones while the roll starter roofing product is in a rolled configuration; and
- a lower release zone placed on the lower surface of the starter sheet and contacting the plurality of upper adhesive zones while the roll starter roofing product is in the rolled configuration.

4. The roll starter roofing product of claim 3, wherein the upper release zone and the lower release zone both comprise release tape.

5. The roll starter roofing product of claim 4, wherein an alpha-numeric marker is printed on the release tape, the alpha-numeric marker identifying one or more of a production date, a production plant, or a production company.

6. The roll starter roofing product of claim 1, further comprising:
- a selvedge section located on the adhesive portion on an in-roof side of the starter sheet; and
- a release tape applied to an anterior surface of the selvedge section.

7. The roll starter roofing product of claim 6, wherein a marker is printed on the release tape, the marker identifying one or more of a production date, a production plant, a production company, or a nailing schedule.

* * * * *